US005511490A

United States Patent [19]

Fendall et al.

[11] Patent Number: 5,511,490

[45] Date of Patent: Apr. 30, 1996

[54] RAILWAY BASKET CAR FOR TRANSPORTING SEMITRAILERS

[75] Inventors: Burian Fendall, Budapest, Hungary; Albulescu Sandu, Arad, Romania; Nagy Iosif; Neceaev Vasile, Arad, Romania; Vajay Gyørgy, Solymár, Hungary

[73] Assignee: Párkány Kft., Budapest, Hungary

[21] Appl. No.: 294,009

[22] Filed: Aug. 23, 1994

[51] Int. Cl.[6] ..... B61D 3/18

[52] U.S. Cl. ..... 105/375; 410/54; 410/56

[58] Field of Search ..... 105/355, 371, 105/375, 159, 422; 410/3, 4, 46, 54, 56

[56] References Cited

U.S. PATENT DOCUMENTS 5,074,725 12/1991 Pavlick ..... 105/375 X

FOREIGN PATENT DOCUMENTS 551714 10/1956 Belgium ..... 105/422

177698 4/1986 European Pat. Off. ..... 410/56

572849 12/1993 European Pat. Off. ..... 410/56

1476665 3/1967 France .

2654055 5/1991 France .

4112995 11/1992 Germany ..... 410/54

*Primary Examiner*—Robert J. Oberleitner
*Assistant Examiner*—Kevin D. Rutherford
*Attorney, Agent, or Firm*—Spencer & Frank

[57] ABSTRACT

In the railway basket car (1) according to the invention at least a part of the surface between the longitudinal side beams (2,3) of the basket car (1) is missing, and a basket (4) is arranged between the longitudanal side beams (2,3) in the missing part of the surface of the basket car (1), said basket (4) comprising a bottom part (4*c*) for carrying the semitrailer (17) and two side walls (4*a*) wherein the side walls (4*a*) are provided with means for supporting the basket (4) on the longitudinal side beams (2,3) of the basket car (1) and with lifting lugs (5) and there stop and locating elements on the supporting means and/or the longitudinal side beams (2,3) of the basket car (1).

6 Claims, 3 Drawing Sheets

RAILWAY BASKET CAR FOR TRANSPORTING SEMITRAILERS

The present invention relates to a railway basket car for transporting semitrailers wherein at least a part of the surface between the longitudinal side beams of the basket car is missing.

It is known that railway basket cars provided with a so called pocket are applied for transporting semitrailers during a combined road-railway transport. For the time being, two kinds of railway basket cars provided with pocket are known.

According to the first version, the pocket is a fixed part of the basket car and, accordingly, the trailers should be lifted and placed into the pocket. The semitrailers and some types of the trailers, however, cannot be lifted by a crane because the underframe system is not constructed for that purpose and is not capable to bear the weight of the semitrailer and the load together.

Another kind of railway basket cars is provided with a pocket which may be rotated around a shaft. The pocket may be turned to the side of the basket car together with one of its longitudinal side beams. In this position, the trailer or semitrailer can be shifted directly into the pocket.

The drawback of this railway basket car type is that both the pocket itself and the hydropneumatic operating system is a rather sophisticated construction which is not usual in the art and therefore, a qualified personnel is needed for the loading. Furthermore, the opening and closing operations are rather time consuming.

The object of the present invention is to provide a railway basket car for transporting semitrailers which is of a rather simple construction, does not need special personnel for operating and which enables semitrailers to be loaded by lifting.

Accordingly, the present invention is a railway basket car for transporting semitrailers wherein at least a part of the surface between the longitudinal side beams of the basket car is missing and a basket is arranged between the longitudinal side beams in the missing pad of the surface of the basket car, said basket comprising a bottom part for carrying the semitrailer and two side walls wherein the side walls are provided with means for supporting the basket on the longitudinal side beams of the basket car and with lifting lugs and there are stop and locating elements on the supporting means and/or longitudinal side beams.

The pocket may be lifted from the basket car and a truck can push the semitrailer onto the pocket placed on the ground. Then the wheels are fixed against rotation and the semitrailer is switched off the truck. Thereafter the pocket and the semitrailer can be lifted by a crane and placed to the railway basket car.

According to a preferred embodiment there is provided a transverse stop beam between the longitudinal side beams, at least on one side of the basket and the basket may be provided with a rear edge, too The supporting means may be the upper part of the side walls of the basket, being bent outwardly.

According to another embodiment, the supporting means is the lifting lugs itself.

Yet another embodiment contains extensions on the side walls of the basket supported by hooks fixed on the longitudinal side beams of the basket car.

The basket cars according to the invention enable to load and transport semitrailers which cannot be lifted alone. Such trailers actually are 90–95% of the semitrailers used in Europe nowdays.

On the other hand, the construction of the basket car according to the invention is extremely simple and both the production, the use and the maintenance requirements are on the level generally accepted by the railways in Europe.

Further details and advantages of the invention will be explained by way of examples and by reference to the accompanying drawings, wherein FIG. 1 is a side-view of a railway basket car provided with a basket according to the invention, FIG. 2 is the top-view of the basket car in FIG. 1, FIG. 3 is a cross-section of a side beam of the railway basket car together with a part of the basket showing the supporting means.

FIGS. 7*a* through 7*d* show the steps of loading a semitrailer to the the basket car.

Figure 1:
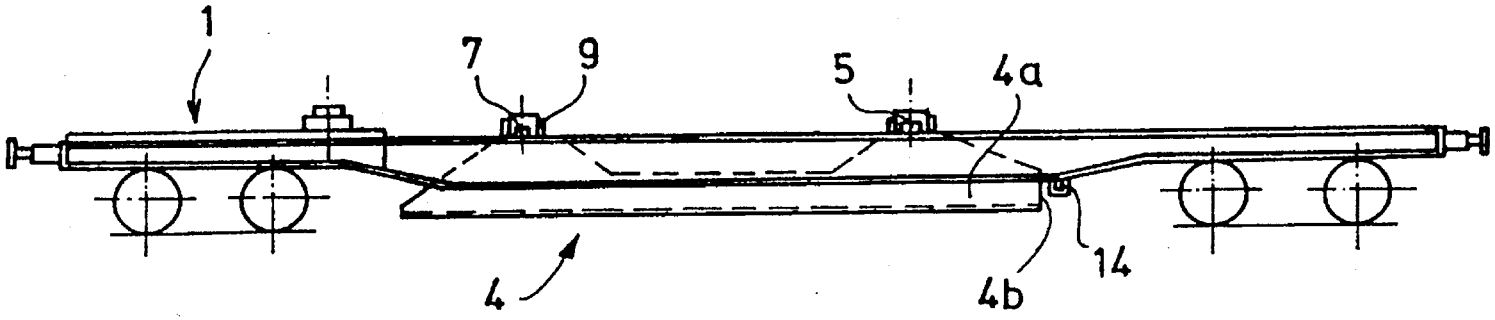
Figure 2:
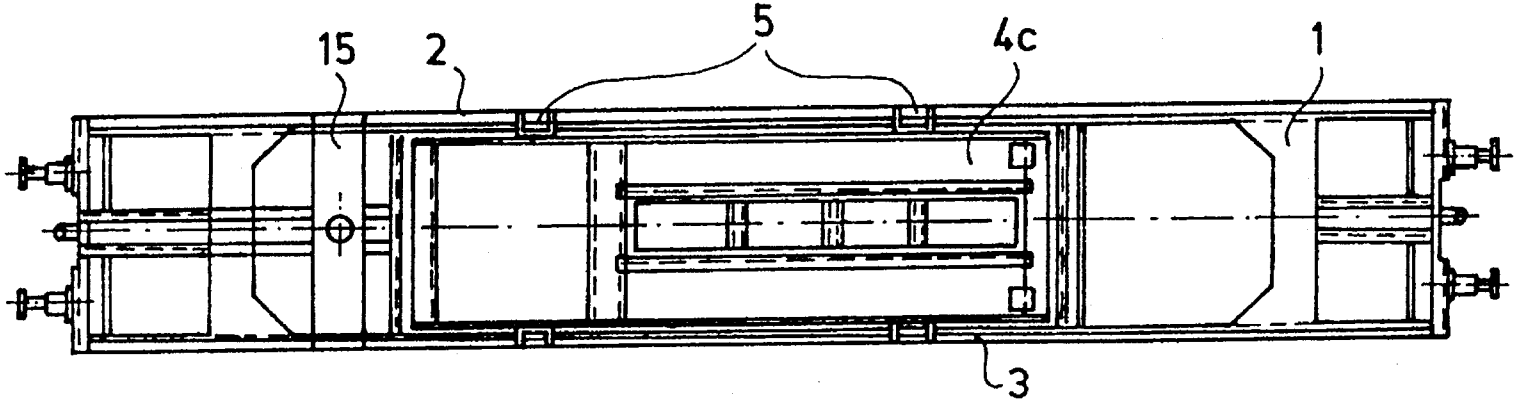

In FIGS. 1 and 2, a railway basket car 1 is shown. Between longitudinal side beams 2 and 3 a surface part of the basket car is missing to constitute a well receiving a basket 4. The basket 4 comprises two side walls 4*a*, a rear edge 4*b* and a bottom part 4*c*. Side walls 4*a* are provided with lifting lugs 5 which enable craning of the basket 4. Basket 4 is arranged between a transverse stop beam 14 and the rotatable base 15 of basket car 1. The lifting lugs 5 of the basket 4 are positioned by stops 7 and 9 arranged on both sides of the lifting lugs 5, on the longitudinal side beams 2 and 3.

Details of the lifting lugs 5 and the locating/stop elements are shown in FIGS. 3 to 6.

Figure 3:
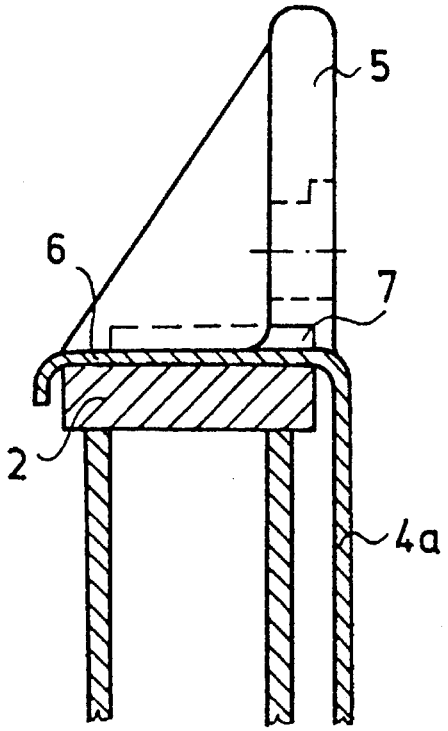

According to the embodiment in FIG. 3, lifting lug 5 is arranged on an extension 6 of the side wall 4*a* of basket 4, which is bent outwardly in order to hold basket 4 on the longitudinal side beam 2, as shown in FIG. 3. Extension 6 and lifting lug 5 are positioned in longitudinal direction by stop 7.

Figure 4:
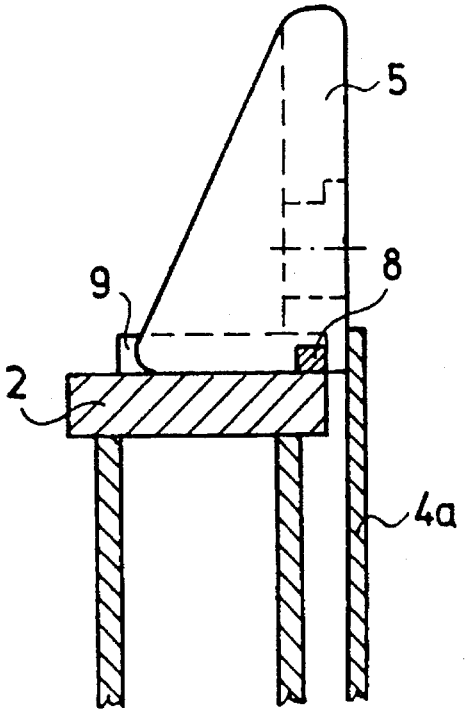
FIG. 4 is another embodiment of the side supporting means.

In FIG. 4, lifting lug 5 itself is the supporting means of the basket 4. Lifting lug 5 is resting directly on the longitudinal side beam 2 and is positioned in longitudinal direction by stop 9. Central position of the whole basket 4 is held by locating block 8 fixed on the longitudinal side beam 2.

Figure 5:
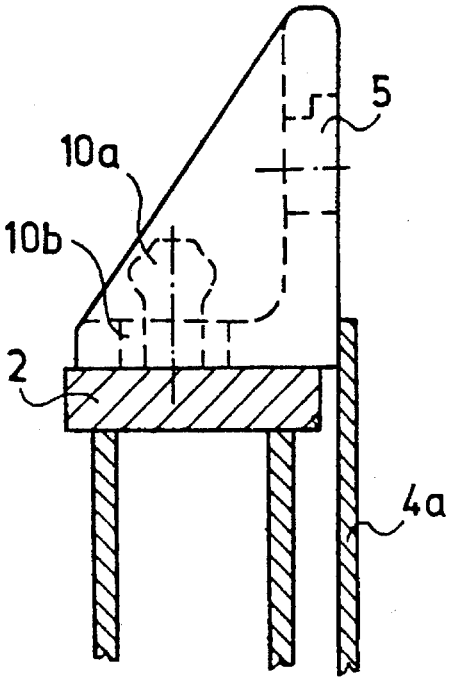
FIG. 5 is a further embodiment of the side supporting means.

In the embodiment according to FIG. 5, locating pin 10*a* and opening 10*b* of the lifting lug 5 are used for stopping and locating basket 4.

Figure 6:
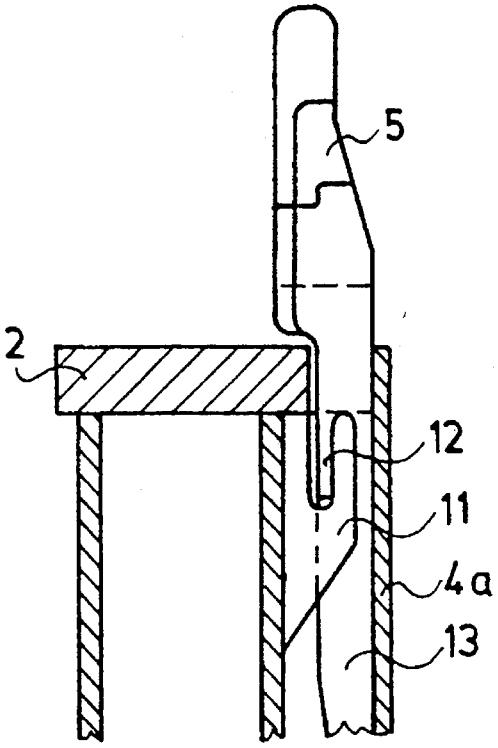
FIG. 6 is yet another embodiment of the supporting means.

FIG. 6 shows another embodiment wherein longitudinal side beam 2 is provided with a hook 11 supporting extension 12 of the side wall 4*a* of the basket 4. The locating/stop element is a guide plate 13 arranged on the side wall 4*a* of the basket 4.

The basket car according to the invention may be used as follows.

Figure 7A:
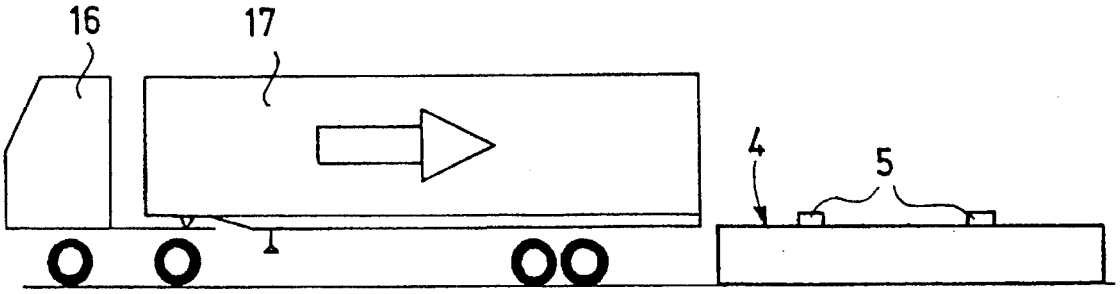

Basket 4 is lifted from the basket car 1 by a crane and is lowered until it lies on the ground, as shown in FIG. 7*a*. Truck 16 provided with semitrailer 17 is backing up as shown in FIG. 7*a* until the wheels of semitrailer 17 reach the rear edge 4*b* of basket 4.

Figure 7B:
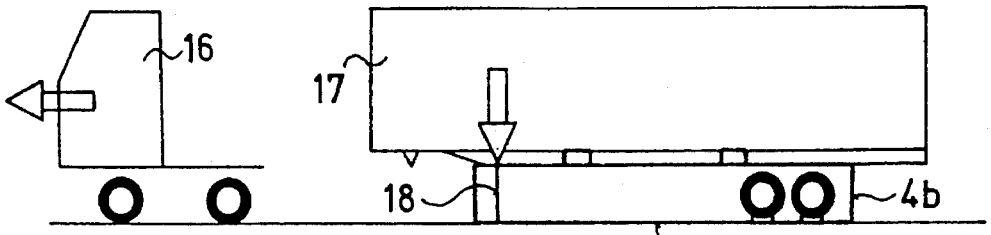
Figure 7C:
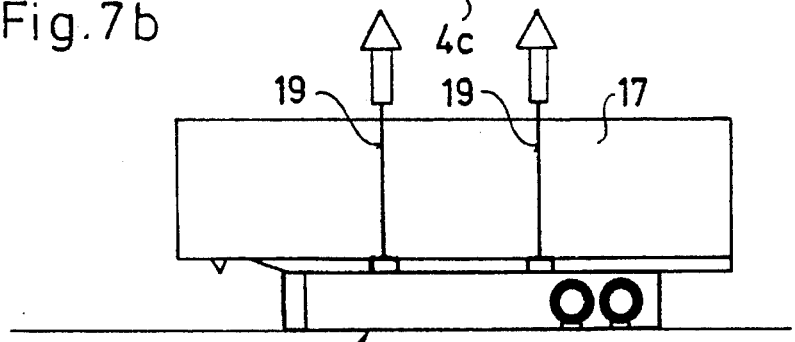
Figure 7D:
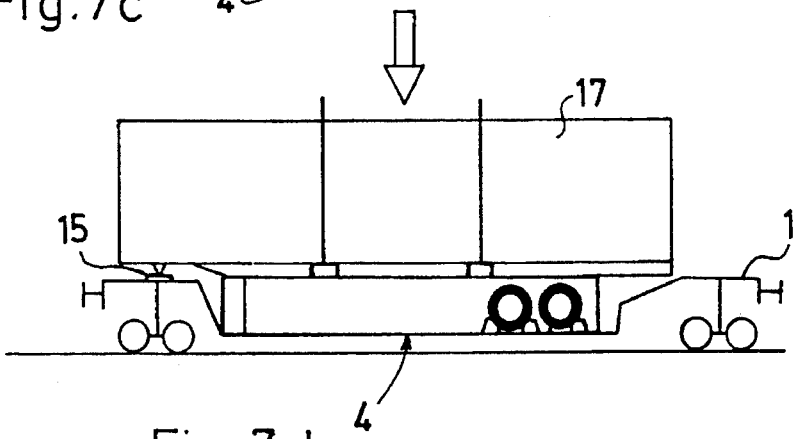

In this position, semitrailer 17 is wedged by leg 18 and is switched off from the truck 16, as shown in FIG. 7*b*. Then cables 19 with hooks are connected to lifting lugs 5 and basket 4 is lifted by a crane together with the semitrailer 17 (FIG. 7*c*). Thereafter, basket 4 and semitrailer 17 are lowered again until basket 4 seats firmly in the opening of the basket car 1, as shown in FIG. 7*d*.

Further adjusting of the position of semitrailer 17 may be carried out by the rotating base 15 of the basket car 1.

The sequence of steps in FIGS. *7a–7d* show that loading of semitrailers to railway basket cars may be carried out quickly and simply according to the invention. Lifting and lowering may be carried out with the usual cranes and the basket will automatically be positioned by the stop and locating elements on the longitudinal side beams and on the side walls of the basket.

It is noted that the embodiments shown in the disclosure are only by way of example and by no means are limiting the scope of protection defined by the attached claims.

We claim:

1. A railway basket car having a normal direction of travel, comprising (a) a car frame including (1) two side-by-side arranged longitudinal side beams extending parallel to said direction and being spaced from one another perpendicularly to said direction; and (2) a transverse stop beam extending between and perpendicularly to said longitudinal side beams adjacent at least one longitudinal end thereof;

(b) a well defined by said car frame; said well being bounded by said longitudinal side beams;

(c) a basket received in said well; said basket having (1) a bottom part for supporting a load thereon;

(2) two side walls; and (3) an edge extending transversely to said side walls at an end of said basket;

(d) support means for supporting said basket in said well; said support means having (1) first supporting parts carried by said side walls and (2) second supporting parts carried by said longitudinal side beams; respective said second supporting parts cooperating with respective said first supporting parts;

(e) a separate lifting lug carried by each said side wall of said basket to be engaged by a hoist for lifting and lowering the basket; and (f) stop and locating means for determining a longitudinal position of said basket in said well.

2. The railway basket car as defined in claim 1, wherein said second supporting parts are formed by upper edge faces of said longitudinal side beams; and further wherein each said lifting lug has an underface situated laterally adjacent said basket; the undersfaces forming said first supporting parts and lying on said upper edge faces.

3. The railway basket car as defined in claim 2, wherein said stop and locating means includes a locating pin extending from at least one of said longitudinal side beams and an opening provided in the underface of a respective said lifting lug; said pin projecting into said opening.

4. The railway basket car as defined in claim 1, wherein said first supporting parts are outwardly bent portions of said side walls and said second supporting parts are formed by upper edge faces of said longitudinal side beams; said outwardly bent portions lying on said upper edge faces.

5. The railway basket car as defined in claims 1, wherein said stop and locating means includes stops carried on said longitudinal side beams for cooperating with the lifting lugs.

6. The railway basket car as defined in claim 1, wherein said first supporting parts of said support means include laterally extended parts of said side walls of said basket and said second supporting parts of said support means include hooks affixed to said longitudinal side beams and receiving respective said laterally extended parts.

* * * * *

UNITED STATES PATENT AND TRADEMARK OFFICE

CERTIFICATE OF CORRECTION

PATENT NO. : 5,511,490
DATED : April 30, 1996
INVENTOR(S) : Fendall Burian et al It is certified that error appears in the above-indentified patent and that said Letters Patent is hereby corrected as shown below:

On the title page:
Item [19], the second line should read --Burian et al--.
Item [75] should read as follows: --Inventors: Fendall Burian, Budapest, Hungary; Sandu Albulescu; Iosif Nagy; Vasile Neceaev, Arad, Romania; György Vajay, Solymár, Hungary--.
Item [73], the assignee's name should read --PÁRKÁNY Kft--.

Signed and Sealed this
First Day of October, 1996

*Attest:*

*Attesting Officer*

Bruce Lehman

BRUCE LEHMAN

*Commissioner of Patents and Trademarks*